US009347446B2

(12) United States Patent
Maeyama et al.

(10) Patent No.: US 9,347,446 B2
(45) **Date of Patent: *May 24, 2016**

(54) REFRIGERANT COMPRESSOR INCLUDING A POLYMERIZATION INHIBITOR CONTAINED THEREIN

(71) Applicant: MITSUBISHI ELECTRIC CORPORATION, Chiyoda-ku, Tokyo (JP)

(72) Inventors: Hideaki Maeyama, Tokyo (JP); Koichi Sato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 15 days.

This patent is subject to a terminal disclaimer.

(21) Appl. No.: 14/221,701

(22) Filed: Mar. 21, 2014

(65) Prior Publication Data

US 2014/0314606 A1 Oct. 23, 2014

(30) Foreign Application Priority Data

Apr. 17, 2013 (JP) ..... 2013-086265

(51) Int. Cl.
*F03C 2/00* (2006.01)
*F03C 4/00* (2006.01)
(Continued)

(52) U.S. Cl.
CPC ..... *F04C 18/3564* (2013.01); *F04C 23/008* (2013.01); *F04C 29/04* (2013.01); *F04C 2210/14* (2013.01); *F04C 2210/26* (2013.01); *F04C 2210/263* (2013.01); *F04C 2240/809* (2013.01)

(58) Field of Classification Search
CPC ..... F04C 23/008; F04C 29/04; F04C 2/46; F04C 2/3566; F04C 18/322; F04C 18/356; F04C 18/3564; F04C 2210/14; F04C 2210/26; F04C 2210/263; F04C 2240/809
USPC ..... 418/63, 243, 248, 84; 62/468, 114; 570/178
See application file for complete search history.

(56) References Cited

U.S. PATENT DOCUMENTS 2,737,533 A * 3/1956 Marks et al. ..... 570/103
5,685,703 A * 11/1997 Fukuoka et al. ..... 418/63
(Continued)

FOREIGN PATENT DOCUMENTS

CN 101608620 A 12/2009
CN 101838552 A 9/2010
(Continued)

OTHER PUBLICATIONS

Office Action dated Jul. 3, 2014 issued in corresponding CN patent application No. 201420187687 (and English translation).
(Continued)

*Primary Examiner* — Theresa Trieu
(74) *Attorney, Agent, or Firm* — Posz Law Group, PLC

(57) ABSTRACT

A refrigerant compressor configured to compress ethylene fluorohydrocarbon or a mixture containing the ethylene fluorohydrocarbon as a refrigerant, the refrigerant compressor including: a compression element configured to compress the refrigerant and including a sliding component that constitutes a sliding portion; and refrigerator oil configured to be supplied to the sliding component so as to lubricate the sliding portion, wherein a polymerization inhibitor configured to suppress polymerization of the refrigerant is contained in the refrigerator oil.

13 Claims, 2 Drawing Sheets

(51) Int. Cl.

| | |
|---|---|
| ***F04C 2/00*** | (2006.01) |
| ***F04C 18/356*** | (2006.01) |
| ***F04C 29/04*** | (2006.01) |
| ***F04C 23/00*** | (2006.01) |

(56) References Cited

U.S. PATENT DOCUMENTS

| | | | | |
|---|---|---|---|---|
| 6,054,064 | A * | 4/2000 | D'Aubarede et al. | 252/67 |
| 7,807,859 | B2 * | 10/2010 | Taguchi et al. | 570/178 |
| 2008/0111100 | A1 | 5/2008 | Thomas et al. | |
| 2008/0157022 | A1 | 7/2008 | Singh et al. | |
| 2009/0283712 | A1 | 11/2009 | Zyhowski et al. | |
| 2011/0000253 | A1 * | 1/2011 | Sato et al. | 62/468 |
| 2011/0041547 | A1 | 2/2011 | Komatsu | |
| 2011/0108756 | A1 | 5/2011 | Tsuchiya et al. | |
| 2011/0126558 | A1 | 6/2011 | Thomas et al. | |
| 2012/0187330 | A1 | 7/2012 | Singh et al. | |
| 2014/0314606 | A1 | 10/2014 | Maeyama et al. | |

FOREIGN PATENT DOCUMENTS

| | | | | |
|---|---|---|---|---|
| CN | 103527484 | A | 1/2014 | |
| CN | 104110375 | A | 10/2014 | |
| EP | 2136083 | A2 * | 12/2009 | F04C 23/00 |
| JP | 10-132398 | A | 5/1998 | |
| JP | 11-246447 | A | 9/1999 | |
| JP | 2008-524433 | A | 7/2008 | |
| JP | 2009-270727 | A | 11/2009 | |
| JP | 2009-299649 | A | 12/2009 | |
| JP | 2010-008002 | A | 1/2010 | |
| JP | 2011-057885 | A | 3/2011 | |
| JP | 2011-058747 | A | 3/2011 | |
| JP | 2011-525204 | A | 9/2011 | |
| WO | WO 2014203353 | A1 * | 12/2014 | C09K 5/04 |

OTHER PUBLICATIONS

Office Action issued Nov. 23, 2015 in the corresponding CN application No. 201410157358.5 (with English translation).

* cited by examiner

REFRIGERANT COMPRESSOR INCLUDING A POLYMERIZATION INHIBITOR CONTAINED THEREIN

CROSS-REFERENCE TO RELATED APPLICATIONS

This application claims priority from Japanese Patent Application No. 2013-086265 filed on Apr. 17, 2013, the entire contents of which are incorporated herein by reference.

TECHNICAL FIELD

Aspects of the invention relate to a refrigerant compressor for use in a refrigerator/air-conditioner and, specifically, to a refrigerant compressor using ethylene fluorohydrocarbon or a mixture containing the ethylene fluorohydrocarbon as a refrigerant.

BACKGROUND

In the field of a car air-conditioner, as a low GWP (Global Warming Potential) refrigerant, there is known HFO-1234yf ($CF_3CF{=}CH_2$) which is propylene fluorohydrocarbon.

Generally, in propylene fluorohydrocarbon having a double bond in its composition, due to the presence of the double bond, resolution or polymerization is easy to occur. Thus, for example, JP-A-2009-299649 discloses a method for suppressing the resolution or polymerization of a refrigerant by forming a surface of a sliding portion of the compressor, where its temperature becomes high and thus the resolution or polymerization of propylene fluorohydrocarbon is easy to occur, by a non-metal component.

Also, tetrafluoroethylene is useful as a monomer for manufacturing fluoro-resin and a fluorine-containing elastomer having excellent heat resistance, chemical resistance and the like. However, since this material is very easy to polymerize, in order to suppress the polymerization, it is necessary to add a polymerization inhibitor to tetrafluoroethylene when it is produced. JP-A-H11-246447 discloses such technology.

SUMMARY

A refrigerant of HFO-1234yf, which is propylene fluorohydrocarbon, has a high standard boiling point of −29° C. and is lower in the operation pressure and smaller in the refrigeration capacity per suction volume than an R410A refrigerant (standard boiling point of −51° C.) or the like used in a stationary air-conditioner. In the stationary air-conditioner, in order to obtain a refrigeration capacity, which is equivalent to that of the R410A refrigerant, by using the HFO-1234yf refrigerant, a volume flow rate of the refrigerant must be increased. In this case, there were problems due to increase in a displacement of the compressor, and problems of increase in the pressure loss of the refrigerant and deterioration in the efficiency due to the increased volume flow rate.

Thus, when a low GWP refrigerant is applied to a stationary air-conditioner, a low GWP refrigerant of a low standard boiling point is suitable. Generally, there is a tendency that, the smaller the carbon number of a refrigerant is, the lower the low boiling point thereof is. Therefore, when compared with using propylene fluorohydrocarbon whose carbon umber is 3 as in related-art, by using ethylene fluorohydrocarbon whose carbon number is 2, a compound of a low boiling point, that is, a refrigerant of a low boiling point can be obtained.

However, when compared with propylene fluorohydrocarbon, since ethylene fluorohydrocarbon is high in reactivity, is thermally and chemically unstable and is easy to resolve or polymerize, it is difficult to suppress the resolution or polymerization by using only the method disclosed in JP-A-2009-299649.

Also, when ethylene fluorohydrocarbon is used as the refrigerant, resolution or polymerization is easy to occur from just after the time of production of the refrigerant, and even during the storage thereof, resolution or polymerization occurs. To suppress the resolution or polymerization of the refrigerant at and after the storage thereof, to a refrigerant constituted of ethylene fluorohydrocarbon, polymerization inhibitor as disclosed in, for example, JP-A-H11-246447, is added to the refrigerator to suppress polymerization at and after the time of production of the refrigerant. Therefore, since the polymerization inhibitor is contained in the refrigerant, it was thought that there is no need to add a polymerization inhibitor to the refrigerator oil. However, even when the polymerization inhibitor has been added to the refrigerant, since the refrigerant circulates within a refrigeration circuit while repeating phase change between liquid and gas, in a sliding portion of a compressor or in a winding portion of a motor where the temperature becomes high and thus polymerization is easy to occur, the refrigerant vaporizes. Since the polymerization inhibitor is contained in the vaporized refrigerant and is carried out together therewith, it may not be sufficiently supplied to the sliding portion of the compressor or the winding portion of the motor, which makes it difficult to obtain a sufficient suppressing effect on the polymerization of the refrigerant.

Aspects of the invention is made to solve the above-described problems and an object thereof is to, in a refrigerant compressor using ethylene fluorohydrocarbon or a mixture containing the ethylene fluorohydrocarbon as a refrigerant, suppress polymerization of the refrigerant in a sliding portion of a compression element.

According to an aspect of the present invention, there is provided a refrigerant compressor configured to compress ethylene fluorohydrocarbon or a mixture containing the ethylene fluorohydrocarbon as a refrigerant, the refrigerant compressor including: a compression element configured to compress the refrigerant and including a sliding component that constitutes a sliding portion; and refrigerator oil configured to be supplied to the sliding component so as to lubricate the sliding portion, wherein a polymerization inhibitor configured to suppress polymerization of the refrigerant is contained in the refrigerator oil.

According to another aspect of the present invention, there is provided a refrigerant compressor configured to compress ethylene fluorohydrocarbon or a mixture containing the ethylene fluorohydrocarbon as a refrigerant, the refrigerant compressor including: a compression element configured to compress the refrigerant and including a sliding component that constitutes a sliding portion, wherein the sliding component is a sintered component in which a polymerization inhibitor configured to suppress polymerization of the refrigerant is contained.

According to another aspect of the present invention, there is provided a refrigerant compressor configured to compress ethylene fluorohydrocarbon or a mixture containing the ethylene fluorohydrocarbon as a refrigerant, the refrigerant compressor including: a compression element configured to compress the refrigerant; and an electric element configured to drive the compression element and including windings, wherein a polymerization inhibitor configured to suppress polymerization of the refrigerant is contained in a gap between the windings.

Accordingly, the polymerization of the refrigerant can be suppressed by the polymerization inhibitor of the refrigerator oil.

DETAILED DESCRIPTION

Embodiment 1

Hereinafter, embodiments of the invention will be described with reference to a rotary compressor as an example of a refrigerant compressor. Here, although a single cylinder rotary compressor will be described as an example, the invention may also be carried out by using a multiple cylinder rotary compressor.

Figure 1:
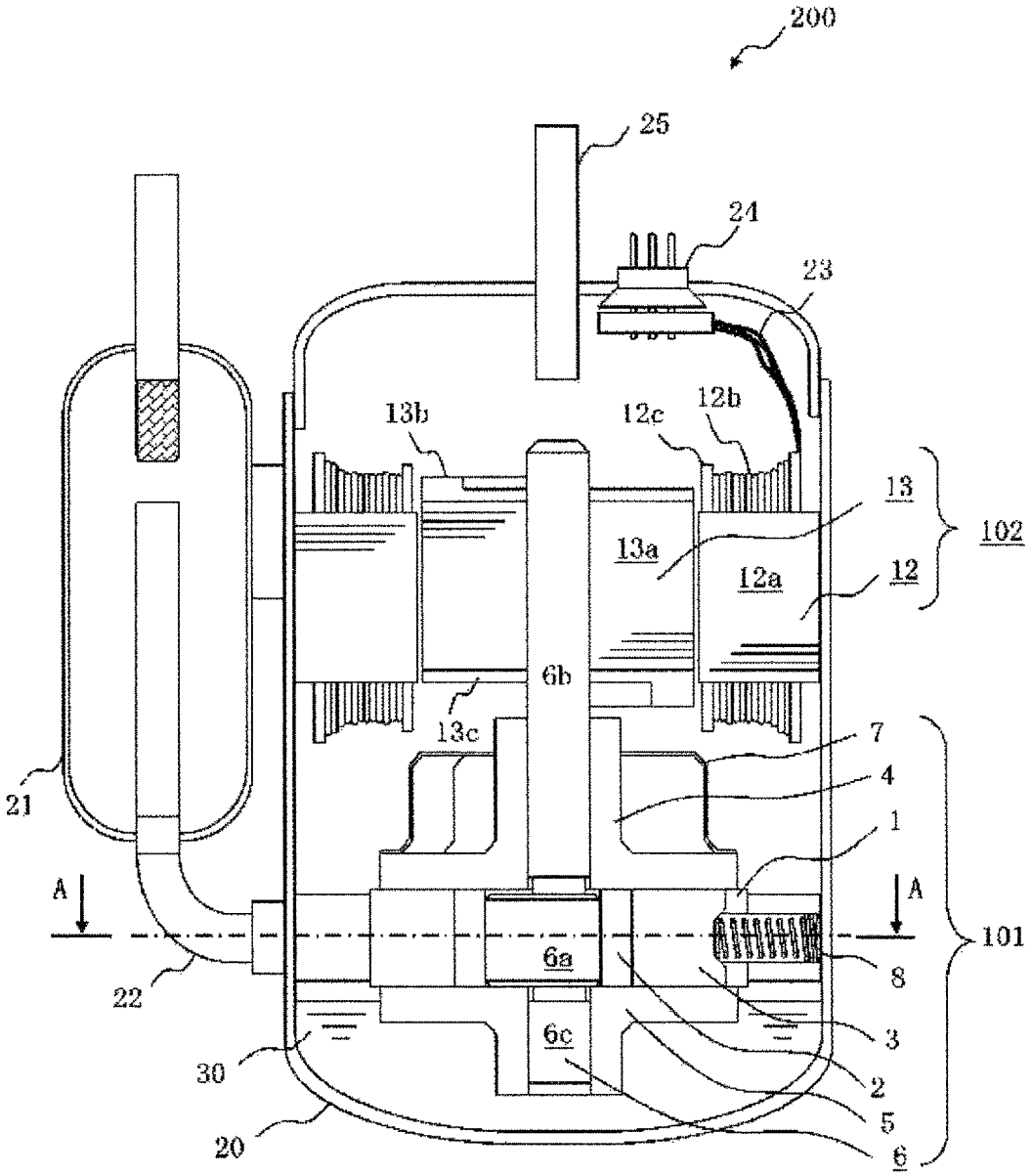
FIG. 1 is a longitudinal section view of a refrigerant compressor according to embodiment 1 of the present invention.
Figure 2:
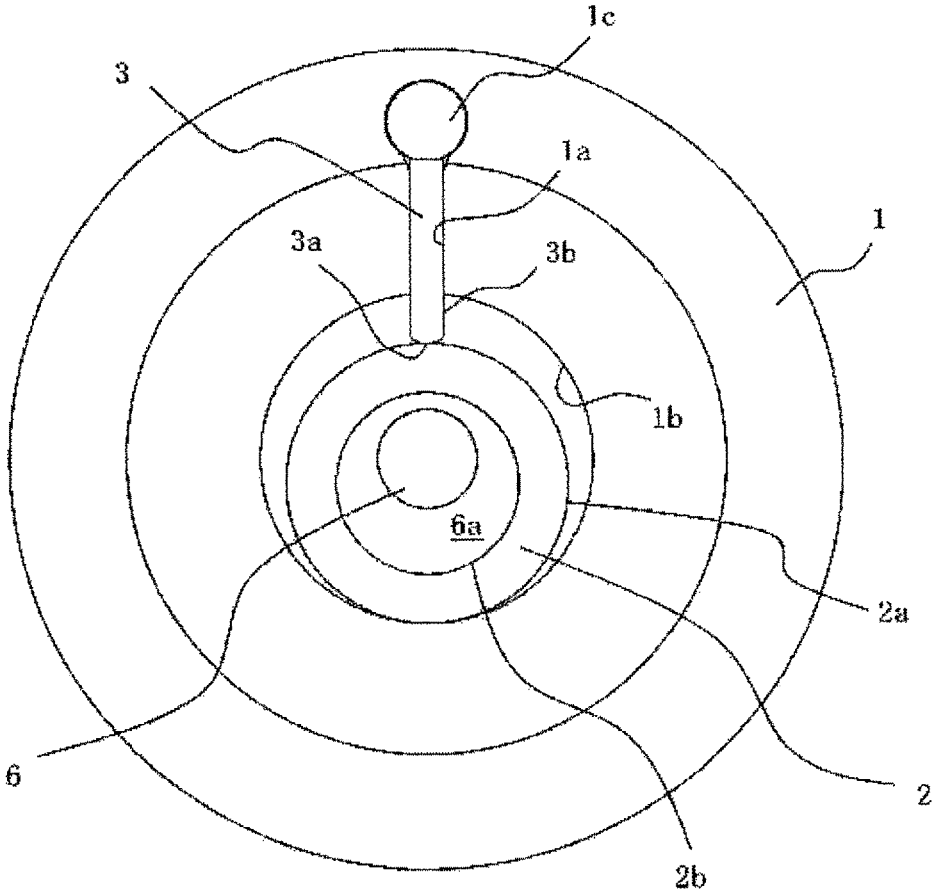
FIG. 2 is a section view of the refrigerant compressor according to the embodiment 1 of the present invention, taken along the A-A line shown in FIG. 1.

FIGS. 1 and 2 show embodiment 1. FIG. 1 is a longitudinal section view of a rotary compressor 200 and FIG. 2 is a section view taken along the A-A line shown in FIG. 1.

Hereinafter, the whole structure of the rotary compressor 200 will be briefly described.

An example of the rotary compressor 200 shown in FIG. 1 is a vertical type compressor including a sealed container 20 having high internal pressure. A compression element 101 is accommodated in the lower portion of the inside of the sealed container 20. An electric element 102 for driving the compression element 101 is accommodated above the compression element 101 in the upper portion of the inside of the sealed container 20.

Refrigerator oil 30 for lubricating respective sliding portions of the compression element 101 is accommodated in the bottom portion of the inside of the sealed container 20.

Firstly, the structure of the compression element 101 will be described. A cylinder 1 containing a compression chamber therein includes an outer periphery having a substantially circular shape when viewed from above and also includes therein a cylinder chamber 1*b* which is a space having a substantially circular shape when viewed from above. The cylinder chamber 1*b* is opened at both axial-direction ends thereof. The cylinder 1 has a predetermined axial-direction height when viewed from the side.

The cylinder 1 includes parallel vane grooves 1*a* formed such that it penetrates the cylinder 1 in the axial direction. Each vane groove communicates with the cylinder chamber 1*b* formed of a substantially circular space in the cylinder 1 and extends in the radial direction of the cylinder 1.

At a back side (outside) of the vane groove 1*a*, there is formed a back pressure chamber 1*c* which is a space communicating with the vane groove 1*a* and having a substantially circular shape when viewed from the above.

The cylinder 1 has an intake port (not shown) through which suction gas from an externally provided refrigeration circuit passes. The intake port penetrates through the cylinder chamber 1*b* from the outer peripheral surface of the cylinder 1.

The cylinder 1 includes a discharge port (not shown) formed by cutting off a portion adjacent to a circle forming the cylinder chamber 1*b* (end face at the electric element 102 side) which is a substantially circular space.

The cylinder 1 is made of gray iron, a sinter, carbon steel or the like.

A rolling piston 2 eccentrically rotates within the cylinder chamber 1*b*. The rolling piston 2 has a ring-like shape and the inner periphery of the rolling piston 2 is slidably engaged with an eccentric shaft portion 6*a* of a crank shaft 6.

The rolling piston 2 and the cylinder 1 perform the eccentric movement such that the outer periphery of the rolling piston 2 almost follows the inner wall of the cylinder chamber 1*b* of the cylinder 1.

The rolling piston 2 is made of, for example, alloy steel containing chromium or the like.

A vane 3 is accommodated in the vane groove 1*a* of the cylinder 1 and is always pressed against the rolling piston 2 by a vane spring 8 provided in the back pressure chamber 1*c*. In the rotary compressor 200, since the sealed container 20 has high internal pressure, when the rotary compressor 200 starts its operation, force caused by a pressure difference between the high internal pressure of the sealed container 20 and the pressure of the cylinder chamber 1*b* acts on the back surface (back pressure chamber 1*c* side) of the vane 3. Thus, the vane spring 8 is mainly used to press the vane 3 against the rolling piston 2 at the start of the rotary compressor 200 (while no pressure difference exists between the inside of the sealed container 20 and cylinder chamber 1*b*).

A shape of the vane 3 is a flat and is substantially a rectangular parallelpiped (the thickness in the peripheral direction is smaller than the lengths in the radial and axial directions).

The vane 3 is made mainly of high speed tool steel.

The main bearing 4 is slidably engaged with the main shaft portion 6*b* (the portion above the eccentric shaft portion 6*a*) of the crank shaft 6 and closes one end face (at the electric element 102 side) of the cylinder chamber 1*b* (including the vane groove 1*a*) of the cylinder 1.

The main bearing 4 includes a discharge valve (not shown). However, the discharge valve may also be included in the main bearing 4, an auxiliary bearing 5, or both of them.

The main bearing 4 has a substantially inverted-T shape when viewed from the side.

The auxiliary bearing 5 is slidably engaged with the auxiliary shaft portion 6*c* (the portion existing downwardly of the eccentric shaft portion 6*a*) of the crank shaft 6 and closes the other end face (existing on the refrigerator oil 30 side) of the cylinder chamber 1*b* (including the vane groove 1*a*) of the cylinder 1.

The auxiliary bearing 5 has a substantially T-like shape when viewed at the side.

The main bearing 4 and the auxiliary bearing 5, similarly to the cylinder 1, are respectively made of gray iron, a sinter, carbon steel or the like.

A discharge muffler 7 is mounted on the outside (the electric element 102 side) of the main bearing 4. Discharge gas of high temperature and high pressure, which is discharged from the discharge valve of the main bearing 4, enters the discharge muffler 7 and is thereafter ejected from the discharge muffler 7 into the sealed container 20. However, the discharge muffler 7 may also be provided on the auxiliary bearing 5 side.

At a lateral side of the sealed container 20, there is provided a suction muffler 21 which sucks therein refrigeration gas of low pressure from the refrigeration circuit, and suppresses the liquid refrigerant from being directly sucked into the cylinder chamber of the cylinder 1 when liquid refrigerant returns. The suction muffler 21 is connected through a suction pipe 22 to the suction port of the cylinder 1. The main body of the suction muffler 21 is fixed to the side surface of the sealed container 20 by welding or the like.

Next, the structure of the electric element 102 will be described. A brushless DC motor is used as the electric element 102. However, an induction motor may also be used as the electric element 102.

The electric element 102 includes a stator 12 and a rotor 13. The stator 12 is engaged with and fixed to the inner peripheral surface of the sealed container 20, and the rotor 13 is disposed inside the stator 12 with a clearance therebetween.

The stator 12 includes a stator iron core 12*a*, which is produced by punching an electromagnetic steel plate having a thickness of 0.1 to 1.5 mm into a predetermined shape, laminating a predetermined number of punched pieces in the axial direction and fixing them together by caulking, by welding or the like. Further, the stator 12 includes a three-phase winding 12*b* wound on a plurality of teeth portions (not shown) of the stator iron core 12*a* by a concentrated winding method. The winding 12*b* is wound on the teeth portion through an insulation member 12*c*. The winding 12*b* is made of copper wires coated with AI (amid imide)/EI (ester imide) or the like. For the insulation member 12*c*, PET (polyethylene terephtalate), PBT (polybutylene terephtalate), FEP (tetrafluoroethylene hexafluoropropylene copolymer (4.6 Fluorinated)), PFA (tetrafluoroethylene perfluoro alkyl vinyl ether copolymer), PTFE (polytetrafluoroethylene), LCP (liquid crystal polymer), PPS (polyphenylenesulfide), phenol resin and the like are mainly used.

The winding 12*b* partially projects from the two axial-direction ends (in FIG. 1, the axial-direction upper and lower ends) of the stator iron core 12*a*. The projected portions are called coil ends. In FIG. 1, the portion designated by the reference (12*b*) is one (counter compression element 101 side) coil end of the winding 12. A lead wire 23 is connected to a terminal (not shown) which is mounted on the insulation member 12*c*.

Notches (not shown) are formed to an outer periphery of the stator iron core 12*a* at multiple positions with substantially regular intervals. These notches constitute one of passages for the discharge gas which is discharged from the discharge muffler 7 into the sealed container 20 and also serve as a passage through which the refrigerant oil 30 returns from the top of the electric element 102 to the bottom of the sealed container 20.

The rotor 13 arranged inside the stator 12 with a clearance (normally, about 0.3 to 1 mm) therebetween includes a rotor iron core 13*a*, which, similarly to the stator iron core 12*a*, is produced by punching an electromagnetic steel plate having a thickness of 0.1 to 1.5 mm into a predetermined shape, laminating a given number of punched pieces in the axial direction and fixing them together by caulking, by welding or the like. Further, the rotor 13 includes a permanent magnet (not shown) to be inserted into a permanent magnet insertion hole (not shown) formed in the rotor iron core 13*a*. As the permanent magnet, there is used a magnet such as a ferrite or a rare earth.

In order to prevent the permanent magnet inserted in the permanent magnet insertion hole from falling off in the axial direction, end plates are provided at the two axial-direction ends (in FIG. 1, axial-direction upper and lower ends) of the rotor 13. The rotor 13 includes an upper end plate 13*b* on the axial-direction upper end portion and a lower end plate 13*c* on the axial-direction lower end portion.

The upper and lower end plates 13*b* and 13*c* serve as rotation balancers. Further, the upper and lower end plates 13*b* and 13*c* are integrally caulked and fixed by using multiple fixing rivets and the like (not shown).

The rotor iron core 13*a* has multiple penetration holes (not shown) penetrating therethrough substantially in the axial direction and serving as gas passages for the discharge gas.

A terminal 24, which is to be connected to a power supply serving as the electric power supply source, is fixed to the sealed container 20 by welding. In the example of FIG. 1, the terminal 24 is provided on the upper surface of the sealed container 20. To the terminal 24, the lead wire 23 from the electric element 102 is connected.

Into the upper surface of the sealed container 20, a discharge pipe 25 having two open ends is fitted. The discharge gas discharged from the compression element 101 is discharged from within the sealed container 20 through the discharge pipe 25 to an external refrigeration circuit.

Here, when the electric element 102 is configured by an induction motor, the rotor 13 has a rotor iron core 13*a* produced by punching an electromagnetic steel plate having a thickness of 0.1 to 1.5 mm into a specified shape, laminating a given number of punched pieces in the axial direction and fixing them together by caulking by welding or the like. Further, the rotor 13 has and a squirrel-cage winding produced by filling or inserting a conductor made of aluminum or copper into a slot formed in the rotor iron core 13*a*, while the two ends of the conductor are short-circuited by an end ring.

As the refrigeration oil 30 to be accumulated in the bottom portion of the inside of the sealed container 20, there is used, for example, POE (polyol ester) which is synthetic oil, PVE (polyvinyl ether) and AB (arkylbenzen). As the viscosity of the oil, there is selected the viscosity that sufficiently lubricates the rotary compressor 200 including the mixing of the refrigerant into the oil and also prevents the efficiency of the rotary compressor 200 from being reduced. Generally, the kinematic viscosity (at 40° C.) of base oil is about 5 to 300 [cSt].

The refrigerator oil contains 0.1% to 5% of limonene as a refrigerant polymerization inhibitor.

In the compressor, trans-1, 2, difuluoroethylene (R1132 (E)) which is a low-boiling-point refrigerant similarly to R410A, is used as the refrigerant.

General operation of the rotary compressor 200 will be described. When power is supplied from the terminal 24 and lead wire 23 to the stator 12 of the electric element 102, the rotor 13 rotates. Then, the crank shaft 6 fixed to the rotor 13 rotates, whereby the rolling piston 2 rotates eccentrically within the cylinder chamber 1*b* of the cylinder 1. A space between the cylinder chamber 1*b* of the cylinder 1 and the rolling piston 2 is divided into two by the vane 3. With the rotation of the crank shaft 6, the volumes of the two spaces change. Specifically, one space sucks therein the refrigerant from the suction muffler 21 due to its gradually increased volume, while the other space compresses the refrigeration gas therein due to its gradually reduced volume. The compressed discharge gas is discharged from the discharge muffler 7 into the sealed container 20, then passes through the electric element 102, and is further discharged from the discharge pipe 25 provided to the sealed container 20 to the outside of the sealed container 20.

The discharge gas flowing through the electric element 102 passes through the penetration hole of the rotor 13 of the electric element 102, an air gap including the slot opening (not shown) of the stator iron core 12*a*, notches formed in the outer periphery of the stator iron core 12*a*, and the like.

When the rotary compressor 200 carries out the above operation, as described below, there are a plurality of sliding portions where the components slide with each other:

(1) First sliding portion: Outer periphery 2*a* of rolling piston 2 and leading end 3*a* (inside) of vane 3;

(2) Second sliding portion: Vane groove 1*a* of cylinder 1 and side surface portions 3*b* of vane 3 (both side surfaces);

(3) Third sliding portion: Inner periphery 2*b* of rolling piston 2 and eccentric shaft portion 6*a* of crank shaft 6;

(4) Fourth sliding portion: Inner periphery of main bearing 4 and main shaft portion 6*b* of crank shaft 6; and, (5) Fifth sliding portion: Inner periphery of auxiliary bearing 5 and auxiliary shaft portion 6*c* of crank shaft 6.

Components, which are provided in the compression element 101 and constitute the sliding portions, are as follows:

(1) Cylinder 1;

(2) Rolling piston 2;

(3) Vane 3:

(4) Main bearing 4;

(5) Auxiliary bearing 5;

(6) Crank shaft 6.

Further, although not shown, there is also known a swing-type rotary compressor in which, as the drive shaft is driven, simultaneously when the projection leading end portion of the vane 3 provided integrally on the rolling piston 2 moves into and out of a support body along the receiving groove of the support body, the support body turns. That is, in the swing-type rotary compressor, the vane 3 advances and retreats in the radial direction while oscillating according to the revolution of the rolling piston 2, thereby always dividing the inside of the cylinder chamber 1*b* to a compression chamber and a suction chamber.

In such swing-type rotary compressor, the projection leading end portion of the vane 3 and the receiving groove of the support body constitute the sliding portion.

Also, between the suction and discharge ports of the cylinder 1, there is formed a cylindrical hold hole. A support body constituted of two semi-cylindrical-shaped members each having a semi-circular-shaped cross section is rotatably engaged to the cylindrical hold hole. Thereby the outer peripheral surface of the support body and the tubular hold hole of the cylinder constitute another sliding portion.

In this embodiment, since trans-1, 2, difluoroethylene (R1132 (E)) is used as a refrigerant, the refrigerant is thermally and chemically unstable and thus resolution or polymerization due to chemical reaction is easy to occur. When the refrigerant is polymerized to produce a polymer, there is a possibility that the inside of the compressor or the refrigeration circuit may be clogged with such polymer. Especially, in a portion where the temperature becomes high, the chemical reaction of the refrigerant is promoted and thus polymerization thereof is easy to occur. Therefore, to suppress the polymerization of the refrigerant, it is necessary to take measures, for example, to attach a polymerization inhibitor to the high temperature portion.

The above-mentioned sliding portions of the compression element and the winding portions of the electric element are portions where the temperatures become high in the compressor. The sliding portion of the compression element generates heat when the components of the compression element slide relative to each other, while the winding portion of the electric element generates heat when a current is supplied to the winding for rotation of the rotor 13.

Since ethylene fluorohydrocarbon has high reactivity, even during storage at room temperature, resolution or polymerization occurs. Therefore, when using ethylene fluorohydrocarbon as the refrigerant, when the refrigerant is produced, a polymerization inhibitor for suppressing the polymerization of the refrigerant is added to the refrigerant. Even during storage, a polymerization inhibitor is always mixed into ethylene fluorohydrocarbon. In a state where ethylene fluorohydrocarbon and polymerization inhibitor are separated from each other, the refrigerant is not used or kept. However, within the compressor, since the resolution of the refrigerant is promoted due to the relative sliding movements of metals, there is a high possibility that the resolvent is polymerized. Thus, even when the polymerization inhibitor is already added to the refrigerant, in the sliding portions of the compression element and the winding portions of the electric element which have high temperature, the refrigerant is evaporated, and the polymerization inhibitor is moved out together with the evaporated refrigerant and is not left in the high-temperature portions. Therefore, the effect of the polymerization inhibitor can not be sufficiently obtained.

On the other hand, the refrigerator oil 30 accumulated in the sealed container 20 is supplied to the respective sliding portions of the compressor by an oiling mechanism (not shown) provided in the compression element to lubricate the sliding portions. Generally, the refrigerant and refrigerator oil are accumulated and transported separately and, when an air-conditioner is assembled, the refrigerant and refrigerator oil are charged into the compressor and refrigeration circuit. Therefore, even when a polymerization inhibitor that suppresses the polymerization of a refrigerant such as limonene is added to the refrigerator oil, since the refrigerator oil and the refrigerant do not mix with each other, the polymerization inhibitor will not act on the refrigerator oil during storage to suppress the polymerization of the refrigerant. Therefore, it is not necessary to add the polymerization inhibitor to the refrigerator oil. Further, even after the refrigerator oil is charged into the compressor and the refrigeration circuit, while the compressor is stopping, although the refrigerant may vaporize and thus may move freely within the refrigeration circuit, the refrigeration oil is accumulated in the bottom portion of the sealed container and is unable to move freely. Therefore, even when the polymerization inhibitor is added to the refrigeration oil, it will not mix with the refrigerant and thus the polymerization inhibitor will not act on the refrigerant to suppress the polymerization thereof. Therefore, while the compressor is stopping, when the polymerization inhibitor is already added to the refrigerant, it is not necessary to add the polymerization inhibitor to the refrigerator oil. However, while the compressor is operating, by adding a polymerization inhibitor to the refrigerator oil, the polymerization inhibitor may be supplied to the sliding portions together with the refrigerator oil, whereby a sufficient amount of polymerization inhibitor may be kept at the sliding portions. Thus, even when the sliding portions become high in temperature, the refrigerant may be suppressed from being polymerized. Therefore, the polymerization inhibitor may fulfill its effect. Also, the high-temperature refrigerant compressed by the compression element, as described above, passes through the electric element 102 and is discharged outside the sealed container 20 from the discharge pipe 25 provided on the upper surface of the sealed container 20. In this case, since the refrigerant flows fast, a part of the refrigerator oil containing limonene is conveyed to the electric element while it is molten in the refrigerant. The refrigerant conveyed to the electric element collides with the electric element and then the refrigerant and refrigerator oil are separated from each other, whereby the refrigerant flows toward the discharge pipe 25 existing upward and the refrigerator oil returns to the bottom portion of the sealed container where the refrigerator oil is accumulated. A portion of the separated refrigerator oil attaches to the winding of the electric element when colliding with the electric element and is temporarily kept thereto. Thus, even when the winding becomes high in temperature, the refrigerant is suppressed from being polymerized, so that the polymerization inhibitor may provide its effect.

As described above, in the sliding portions of the compression element and the winding portions of the electric element which become high in temperature in the compressor, by supplying the refrigerator oil containing limonene as a polymerization inhibitor, a sufficient amount of polymerization inhibitor may be kept.

Also, the polymerization inhibitor contained in the refrigerant acts on the vaporized refrigerant, thereby effectively suppressing the polymerization of the refrigerant.

Thus, at high temperature portions where polymerization is easy to occur, the polymerization can be suppressed by the refrigerator oil containing limonene. Therefore, even by using a refrigerant that easily polymerizes, sufficient reliability can be maintained.

In the above description, there has been shown an example using trans-1, 2, difluoroethylene (R1132 (E)) as a refrigerant. However, using fluoroethylene (R1141), cis-1, 2 difluoroethylene (R1132 (Z)), 1, 1 difluoroethylene (R1132a), 1, 1, 2 trifluoroethylene (R1123) or the like can provide similar effects.

In the above description, limonene is used as a polymerization inhibitor contained in the refrigerator oil. However terpene hydrocarbon such as pecan, camphene, cymene and terpene, or terpene alcohol such as cirtronellol, terpineol and borneol may also be used.

Embodiment 2

The embodiment 1 showed a method in which, in the portion easy to increase in temperature, a sufficient amount of refrigerator oil containing a polymerization inhibitor is provided to thereby suppress polymerization. However, the polymerization inhibitor may also be contained in the sliding component in advance. This method will be described hereinafter.

The cylinder 1, the main bearing 4 and the auxiliary bearing 5 shown in the embodiment 1 may also be configured by porous sintered components. A polymerization inhibitor or refrigerator oil containing the polymerization inhibitor is impregnated in these sintered components in advance and a compressor is then assembled. In this method, since, within the compressor cylinder or in the sliding portion easy to increase in temperature, the polymerization inhibitor leaks out from the sintered components, the polymerization of the refrigerant can be further suppressed.

Thus, even when the polymerizing condition of the refrigerant is satisfied in a state where the amount of the refrigerator oil charged into the sliding portion of the compression element is not sufficient, the polymerization of the refrigerant can be suppressed by the polymerization inhibitor held by the sintered component.

Embodiment 3

Other than the sliding portion, in the winding portion of the electric element which is also easy to increase in temperature, similarly to the embodiment 2, a polymerization inhibitor may also be contained in advance. This method will be described hereinafter.

In the winding portion 12*b* of the electric element, when each winding has a circular section, a gap exists between one winding and another winding. The gap between the windings, similarly to the porous property of the sintered component, is capable of containing and holding therein a polymerization inhibitor or refrigerator oil containing a polymerization inhibitor. For example, a polymerization inhibitor is contained in working oil for use in a winding process, or a winding is immersed in a polymerization inhibitor. Since a polymerization inhibitor in the winding portion 12*b* is sufficiently supplied to the winding portion where polymerization occurs, the refrigerant polymerization preventive effect may be enhanced.

Thus, even when the refrigerant polymerization condition is satisfied in a state where the amount of the refrigerator oil charged into the sliding portion of the winding portion of the electric element is not sufficient, the polymerization of the refrigerant can be suppressed by the polymerization inhibitor contained in the winding portion.

Embodiment 4

The refrigerator oil used in the above embodiments generally contains a wear preventing agent. While the wear preventing agent has a function of preventing the wear of the sliding portions by the resolution of itself, it is known that the resolvent of the wear preventing agent reacts with the resolvent of the easily resolvable ethylene fluorohydrocarbon or its mixture to generate solids. There is a fear that the solids may accumulate in fine flow passages such as an expansion valve and a capillary tube within a refrigeration cycle to cause clogging and thus poor cooling. In this embodiment, since the refrigerator oil is selected properly such that it does not include an wear preventing agent, there can be provided a refrigerant compressor which does not produce solids generated by the reaction between the resolvent of the wear preventing agent and ethylene fluorohydrocarbon or the resolvent of the mixture thereof, nor cause clogging on the refrigeration circuit, thereby being able to keep excellent performance for a long period of time.

The present invention provides illustrative, non-limiting aspects as follows:

(1) In a first aspect, there is provided a refrigerant compressor configured to compress ethylene fluorohydrocarbon or a mixture containing the ethylene fluorohydrocarbon as a refrigerant, the refrigerant compressor including: a compression element configured to compress the refrigerant and including a sliding component that constitutes a sliding portion; and refrigerator oil configured to be supplied to the sliding component so as to lubricate the sliding portion, wherein a polymerization inhibitor configured to suppress polymerization of the refrigerant is contained in the refrigerator oil.

(2) In a second aspect, there is provided a refrigerant compressor configured to compress ethylene fluorohydrocarbon or a mixture containing the ethylene fluorohydrocarbon as a refrigerant, the refrigerant compressor including: a compression element configured to compress the refrigerant and including a sliding component that constitutes a sliding portion, wherein the sliding component is a sintered component in which a polymerization inhibitor configured to suppress polymerization of the refrigerant is contained.

(3) In a third aspect, there is provided a refrigerant compressor configured to compress ethylene fluorohydrocarbon or a mixture containing the ethylene fluorohydrocarbon as a refrigerant, the refrigerant compressor including: a compression element configured to compress the refrigerant; and an electric element configured to drive the compression element and including windings, wherein a polymerization inhibitor configured to suppress polymerization of the refrigerant is contained in a gap between the windings.

(4) In a fourth aspect, there is provided the refrigerant compressor according to any one of the first to third aspects, wherein the ethylene fluorohydrocarbon includes at least one of fluoroethylene (R1141), trans-1, 2 difluoroethylene (R1132 (E)), cis-1, 2 difluoroethylene (R1132 (Z)), 1, 1 difluoroethylene (R1132a), and 1, 1, 2 trifluoroethylene (R1123).

(5) In a fifth aspect, there is provided the refrigerant compressor according to any one of the first to fourth aspects, wherein the polymerization inhibitor is a terpin compound.

(6) In a sixth aspect, there is provided the refrigerant compressor according to the fifth aspect, wherein the terpin compound is at least one of limonene, pinene, camphene, cymene, terpinen, citronellol, terpineol and bornelol.

(7) In a seventh aspect, there is provided the refrigerant compressor according to any one of the first to sixth aspects, wherein the compression element includes, a ring-shaped rolling piston configured to eccentrically rotate within a cylinder chamber of a cylinder, and a vane accommodated in a vane groove of the cylinder and configured to slide within the vane groove while being pressed against the rolling piston, and wherein the sliding portion is constituted of a leading end of the vane and an outer periphery of the rolling piston.

(8) In an eighth aspect, there is provided the refrigerant compressor according to any one of the first to sixth aspects, wherein the compression element includes, a cylinder including a vane groove, and a vane accommodated in the vane groove of the cylinder and configured to slide within the vane groove, and wherein the sliding portion is constituted of the vane groove and the vane.

(9) In a ninth aspect, there is provided the refrigerant compressor according to any one of the first to sixth aspects, wherein the compression element includes, a ring-shaped rolling piston configured to eccentrically rotate within a cylinder chamber of a cylinder, and a crank shaft having an eccentric shaft portion eccentric to a main shaft portion, and wherein the sliding portion is constituted of an inner periphery of the rolling piston and the eccentric shaft portion of the crank shaft.

(10) In a tenth aspect, there is provided the refrigerant compressor according to any one the first to sixth aspects, wherein the compression element includes, a crank shaft having a main shaft portion and an auxiliary shaft portion, a main bearing configured to slidably engage with the main shaft portion of the crank shaft, and an auxiliary bearing configured to slidably engage with the auxiliary shaft portion of the crank shaft, and wherein the sliding portion is constituted of the main bearing, the auxiliary bearing and the crank shaft.

What is claimed is:

1. A refrigerant compressor configured to compress ethylene fluorohydrocarbon or a mixture containing the ethylene fluorohydrocarbon as a refrigerant, the refrigerant compressor comprising:

a compression element configured to compress the refrigerant and including a sliding component that constitutes a sliding portion;

refrigerator oil configured to be supplied to the sliding component so as to lubricate the sliding portion; and a polymerization inhibitor configured to suppress polymerization of the refrigerant contained in the refrigerator oil.

2. The refrigerant compressor according to claim 1, wherein the ethylene fluorohydrocarbon includes at least one of fluoroethylene (R1141), trans-1, 2 difluoroethylene (R1132 (E)), cis-1, 2 difluoroethylene (R1132 (Z)), 1, 1 difluoroethylene (R1132a), and 1, 1, 2 trifluoroethylene (R1123).

3. The refrigerant compressor according to claim 1, wherein the polymerization inhibitor is a terpin compound.

4. The refrigerant compressor according to claim 3, wherein the terpin compound is at least one of limonene, pinene, camphene, cymene, terpinen, citronellol, terpineol and bornelol.

5. The refrigerant compressor according to claim 1, wherein the compression element includes, a ring-shaped rolling piston configured to eccentrically rotate within a cylinder chamber of a cylinder, and a vane accommodated in a vane groove of the cylinder and configured to slide within the vane groove while being pressed against the rolling piston, and wherein the sliding portion is constituted of a leading end of the vane and an outer periphery of the rolling piston.

6. The refrigerant compressor according to claim 1, wherein the compression element includes, a cylinder including a vane groove, and a vane accommodated in the vane groove of the cylinder and configured to slide within the vane groove, and wherein the sliding portion is constituted of the vane groove and the vane.

7. The refrigerant compressor according to claim 1, wherein the compression element includes, a ring-shaped rolling piston configured to eccentrically rotate within a cylinder chamber of a cylinder, and a crank shaft having an eccentric shaft portion eccentric to a main shaft portion, and wherein the sliding portion is constituted of an inner periphery of the rolling piston and the eccentric shaft portion of the crank shaft.

8. The refrigerant compressor according to claim 1, wherein the compression element includes, a crank shaft having a main shaft portion and an auxiliary shaft portion, a main bearing configured to slidably engage with the main shaft portion of the crank shaft, and an auxiliary bearing configured to slidably engage with the auxiliary shaft portion of the crank shaft, and wherein the sliding portion is constituted of the main bearing, the auxiliary bearing and the crank shaft.

9. A refrigerant compressor configured to compress ethylene fluorohydrocarbon or a mixture containing the ethylene fluorohydrocarbon as a refrigerant, the refrigerant compressor comprising:

a compression element configured to compress the refrigerant and including a sliding component that constitutes a sliding portion, wherein the sliding component is a sintered component impregnated with a polymerization inhibitor configured to suppress polymerization of the refrigerant.

10. The refrigerant compressor according to claim 9, wherein the sliding component, which is impregnated with the polymerization inhibitor, is configured to release the polymerization inhibitor.

11. The refrigerant compressor according to claim 10, wherein the sliding component is configured to release the polymerization inhibitor when the temperature of the sliding component increases.

12. The refrigerant compressor according to claim 9, wherein the sliding component is a porous, sintered component including pores impregnated with the polymerization inhibitor.

13. A refrigerant compressor configured to compress ethylene fluorohydrocarbon or a mixture containing the ethylene fluorohydrocarbon as a refrigerant, the refrigerant compressor comprising:

a compression element configured to compress the refrigerant;

an electric element configured to drive the compression element and including windings; and a polymerization inhibitor configured to suppress polymerization of the refrigerant contained in a gap between the windings.

* * * * *